US010130858B2

(12) United States Patent
Lamkin et al.

(10) Patent No.: US 10,130,858 B2
(45) Date of Patent: Nov. 20, 2018

(54) COMPOSITE GOLF CLUB GRIP

(71) Applicant: Lamkin Corporation, San Diego, CA (US)

(72) Inventors: Robert J. Lamkin, San Diego, CA (US); Carl W. Pettersen, San Diego, CA (US); Michael Snow, San Diego, CA (US)

(73) Assignee: LAMKIN CORPORATION, San Diego, CA (US)

( * ) Notice: Subject to any disclaimer, the term of this patent is extended or adjusted under 35 U.S.C. 154(b) by 0 days.

(21) Appl. No.: 15/352,327

(22) Filed: Nov. 15, 2016

(65) Prior Publication Data

US 2018/0133571 A1 May 17, 2018

(51) Int. Cl.

| | |
|---|---|
| ***A63B 53/14*** | (2015.01) |
| ***A63B 60/14*** | (2015.01) |
| ***A63B 60/54*** | (2015.01) |
| ***A63B 60/10*** | (2015.01) |

(52) U.S. Cl.

CPC ..... *A63B 60/14* (2015.10); *A63B 53/14* (2013.01); *A63B 60/10* (2015.10); *A63B 60/54* (2015.10); *A63B 2209/00* (2013.01)

(58) Field of Classification Search

CPC ..... A63B 53/14; A63B 60/54; A63B 60/10; A63B 2209/00; A63B 60/14

See application file for complete search history.

(56) References Cited

U.S. PATENT DOCUMENTS

| | | | | | |
|---|---|---|---|---|---|
| 1,139,843 | A | * | 5/1915 | Brown | A63B 53/14 190/115 |
| 4,180,264 | A | | 12/1979 | Robinson | |
| 4,676,839 | A | * | 6/1987 | Osborn | A63B 60/36 134/25.4 |
| 4,819,939 | A | | 4/1989 | Kobayashi | |
| 5,087,042 | A | * | 2/1992 | Solheim | A63B 53/14 473/303 |
| 5,160,139 | A | * | 11/1992 | Soong | A63B 53/14 473/206 |
| 5,259,614 | A | * | 11/1993 | Greer | A63B 53/10 273/DIG. 23 |
| RE34,767 | E | * | 10/1994 | Soong | A63B 53/14 473/300 |
| 5,398,934 | A | * | 3/1995 | Soong | A63B 53/14 473/299 |

(Continued)

FOREIGN PATENT DOCUMENTS

| | | | |
|---|---|---|---|
| CN | 2527315 | U | 12/2002 |
| CN | 201565059 | U | 9/2010 |

(Continued)

*Primary Examiner* — Stephen Blau

(74) *Attorney, Agent, or Firm* — Procopio, Cory, Hargreaves & Savitch LLP

(57) ABSTRACT

A golf grip for a golf club is disclosed herein. The golf grip includes a closed end, an open end, a composite shell including a laminate composite fiber material, a foam layer, and a shaft cavity. The foam layer is inward of the composite shell. The shaft cavity extends from the open end towards the closed end. The shaft cavity is inward from the composite shell and the foam layer. In embodiments, the golf grip also includes a core tube inward of the composite shell and of the foam layer. The core tube forms a shaft cavity for receiving a shaft of the golf club.

16 Claims, 4 Drawing Sheets

(56) References Cited

U.S. PATENT DOCUMENTS 5,571,050 A 11/1996 Huang et al.
5,575,473 A * 11/1996 Turner ..... A63B 53/007 473/298
5,692,970 A * 12/1997 Nelson ..... A63B 53/10 473/318
5,743,811 A 4/1998 Bird
5,792,551 A * 8/1998 Miyao ..... A63B 49/08 428/304.4
5,846,629 A * 12/1998 Gwinn ..... B32B 37/00 428/68
6,656,057 B2 12/2003 Manual et al.
6,908,400 B2 6/2005 Chu et al.
7,374,498 B2 * 5/2008 Huang ..... A63B 53/14 156/153
8,006,349 B2 8/2011 Gill
8,296,907 B2 10/2012 Gill et al.
8,480,508 B2 * 7/2013 Chu ..... A63B 53/14 473/298
8,518,505 B2 * 8/2013 Huang ..... A01K 87/08 428/35.7
8,845,448 B2 * 9/2014 Huang ..... A63B 53/14 473/300
8,858,356 B2 10/2014 Chu et al.
8,998,753 B2 * 4/2015 Tinti ..... A63B 59/0092 473/520
2002/0077192 A1 6/2002 Chen
2002/0142858 A1 10/2002 Chen
2003/0224865 A1 12/2003 Lai
2006/0011566 A1 * 1/2006 Guy ..... A47B 81/005 211/60.1
2014/0239531 A1 8/2014 Jiansheng
2015/0224370 A1 8/2015 Yamamoto
2016/0136492 A1 5/2016 Mikura et al.

FOREIGN PATENT DOCUMENTS

WO 2010147982 A2 12/2010
WO 2016010853 A1 1/2016

* cited by examiner

COMPOSITE GOLF CLUB GRIP

TECHNICAL FIELD

The present disclosure generally pertains to golf grips, and is also directed toward a golf grip including angled recessed or protruded features.

BACKGROUND

Grips for sporting implements such as golf clubs have taken numerous forms over the years. Early grips consisted of a wrap material, such as leather, in a helical pattern around the handle portion of the golf club. Over the years grips have evolved from the wrap type grip to a tapered cylinder of rubber, polyurethane, TPE, or similar elastomeric and shock absorbing materials that slip over an end of a golf club shaft. These grips are generally formed by a compression molding or an injection molding process.

The choice of rubber and synthetic rubber materials provides multiple benefits for the swinging golf clubs. Rubber is a material that can provide a good coefficient of friction to help the golfer hold the club throughout the swing. Rubber can also dampen vibrations and reduce the magnitude of forces generated by impacting the ball and the ground that reach a golfer's hands, which may prevent injury or reduce the chances of injury.

Since swinging grips were made of rubber, it was natural that putter grips would also be made of rubber. It was easy for manufacturers to apply the same manufacturing methods to the putter grip. Over the last several years the size and shape of the putter grip has evolved to better accommodate the putting stroke, which is much different than a full golf swing stroke. These shapes are larger and more accommodating to the types of methods golfer's use to grip the putter.

Vibration dampening in a putter grip may not be necessary or desirable. For example, dampening vibrations may reduce the feedback the golfer feels when the ball is struck by the putter. This feedback may be valuable to help the golfer determine whether the ball was struck at the center of the club face or whether the ball was struck near the heel or toe of the club face and to help the golfer make the proper adjustments to the putting stroke.

SUMMARY OF THE DISCLOSURE

A golf grip for a golf club is disclosed herein. In embodiments, the golf grip includes a composite shell including an open end, a closed end, a laminate composite fiber material, a foam layer, and a shaft cavity. The foam layer is inward of the composite shell. The shaft cavity extends from the open end towards the closed end. The shaft cavity is inward from the composite shell and the foam layer.

In some embodiments, the golf grip also includes a core tube inward of the composite shell and of the foam layer. The core tube forms a shaft cavity for receiving a shaft of the golf club. In some embodiments, the core tube includes a hollow circular cylinder shape. In embodiments, the grip also includes core protrusions extending from the core tube to the composite shell through the foam layer.

Other features and advantages of the present invention should be apparent from the following description which illustrates, by way of example, aspects of the invention.

DETAILED DESCRIPTION

The apparatus disclosed herein includes a composite golf club grip ("grip"). In embodiments, the grip includes a high modulus hybrid construction that has a composite shell and a foam layer within the composite shell. The composite shell may provide a seamless surface for a golfer to grasp that does not deflect inward as the golfer grasps a putter for a putting stroke, while the foam layer may provide a reduction in weight of the overall grip. In some embodiments, the grip also includes a core that may dampen or transfer vibration to the composite shell from the shaft, which may provide valuable feedback to the golfer during a putting stroke.

Figure 1:
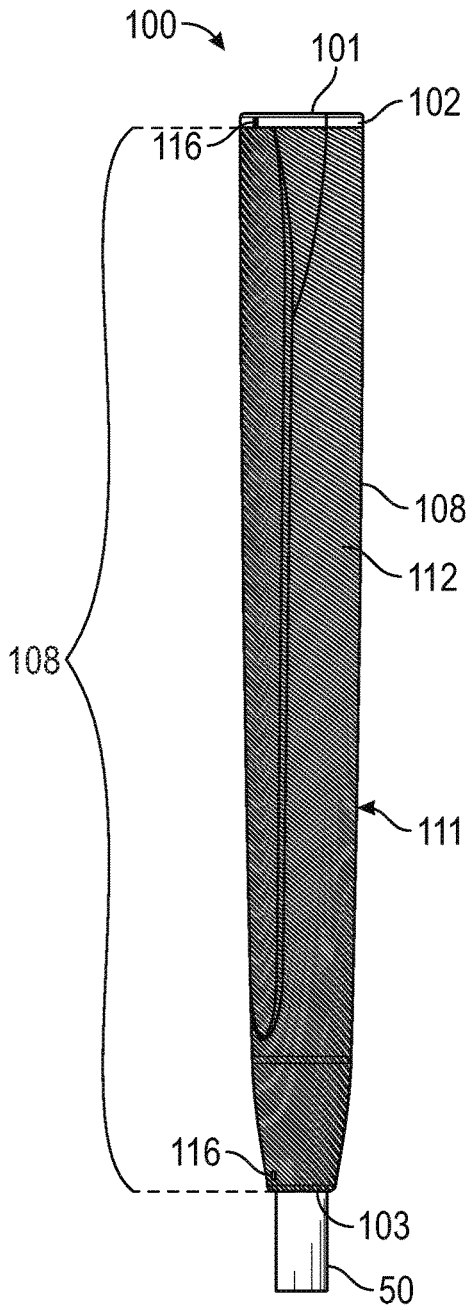
FIG. 1 is a perspective view of the grip mounted to a shaft of a golf club.
Figure 2:
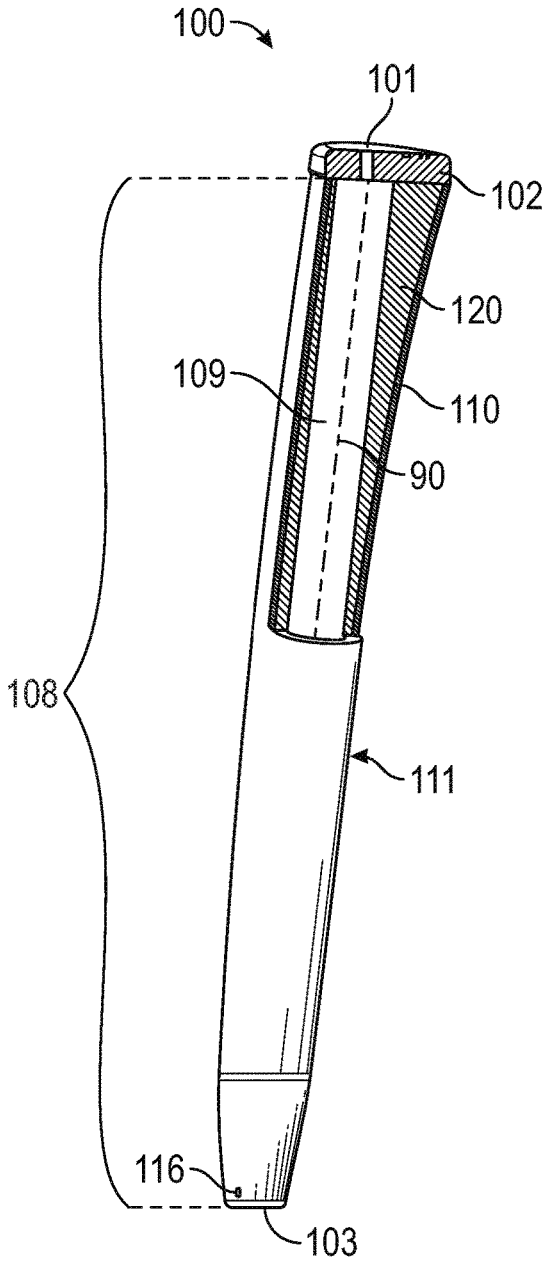
FIG. 2 is a perspective view of an embodiment of the grip of FIG. 1 with a portion of the grip cutaway.

FIG. 1 is a perspective view of the grip 100 mounted to a shaft 50 of a golf club. FIG. 2 is a perspective view of an embodiment of the grip 100 of FIG. 1 with a portion of the grip 100 cutaway. Referring to FIGS. 1 and 2, grip 100 may be affixed to the end of a shaft 50 opposite a club head of a golf club. Grip 100 include may include an open end 103, a closed end 101, a shaft cavity 109, and a body 108. The open end 103 is opposite the closed end 101 and allows the shaft 50 to be inserted into the shaft cavity 109. The closed end 101 may include a cap 102 that is integral to the body 108. The cap 102 may be joined to the body 108, such as molded, glued, or bonded to the body 108. The cap 102 may be pre-molded prior to being joined to the body 108. The cap 102 may include a vent hole 105, which can be used to install the grip 100 onto the shaft 50 and allow the displaced air and installation solvent to escape from the grip shaft cavity 109.

The shaft cavity 109 is the hollow interior of the grip 100 formed by the body 108. The shaft cavity 109 may be sized relative to the diameter of the shaft 50 and extends from the open end 103 toward the closed end 101 and may terminate adjacent to the closed end 101. The shaft cavity 109 may have a shaft cavity axis 90. The shaft cavity axis 90 may be coaxial to the axis of the shaft 50 when the grip 100 is installed onto the shaft 50. All references to radial, axial, and circumferential directions and measures refer to a shaft cavity axis 90, unless specified otherwise, and terms such as "inner" and "outer" generally indicate a lesser or greater radial distance from the shaft cavity axis 90.

The body 108 may include a composite shell 110 and a foam layer 120. The outer surface 111 of the composite shell 110 may be smooth as illustrated in FIG. 2 or may include surface texture 112 as illustrated in FIG. 1. The surface texture 112 may be, inter alia, from the nature of the material used for the composite shell 110, may be formed from an texture layer 114 (shown in FIG. 6) in the composite shell 110, such as a decal, or from a combination thereof.

The composite shell 110 is a hard outer shell of the body 108. The composite shell 110 may be a composite material that includes a matrix and a reinforcement material. The composite shell 110 may be a laminate composite fiber outer shell. The fiber can be, inter alia, carbon, glass, boron, Kevlar, or a combination thereof. In some embodiments, the composite shell 110 is a fiber reinforced plastic. The fiber reinforced plastic may be carbon fiber reinforced polymer, carbon fiber reinforced plastic or carbon fiber reinforced thermoplastic, where the matrix may be a polymer resin, such as epoxy, and the reinforcement is a carbon or synthetic carbon fiber. The polymer resin may be a thermoset or thermoplastic resin. The reinforcement material may include multiple layers of sheets that include the fibers.

The foam layer 120 may be inward from the composite shell 110. The composite shell 110 may surround the foam layer 120. The foam layer 120 may adjoin and be integral to the composite shell 110. The composite shell 110 and the foam layer 120 may be bonded together. In embodiments, the composite shell 110 is formed around the foam layer 120 and bonded to the foam layer 120 during the process of forming the composite shell 110. The shaft cavity 109 is located inward from the foam layer 120. In the embodiment illustrated in FIG. 2, the foam layer 120 is shaped and constructed to form the shaft cavity 109. The foam layer 120 is a light structural portion of the body 108 and may include solid foam. The solid foam may include an open or closed cell structure. The closed cell foam may be syntactic foam. In some embodiments, the foam layer 120 includes polyurethane foam.

Figure 3:
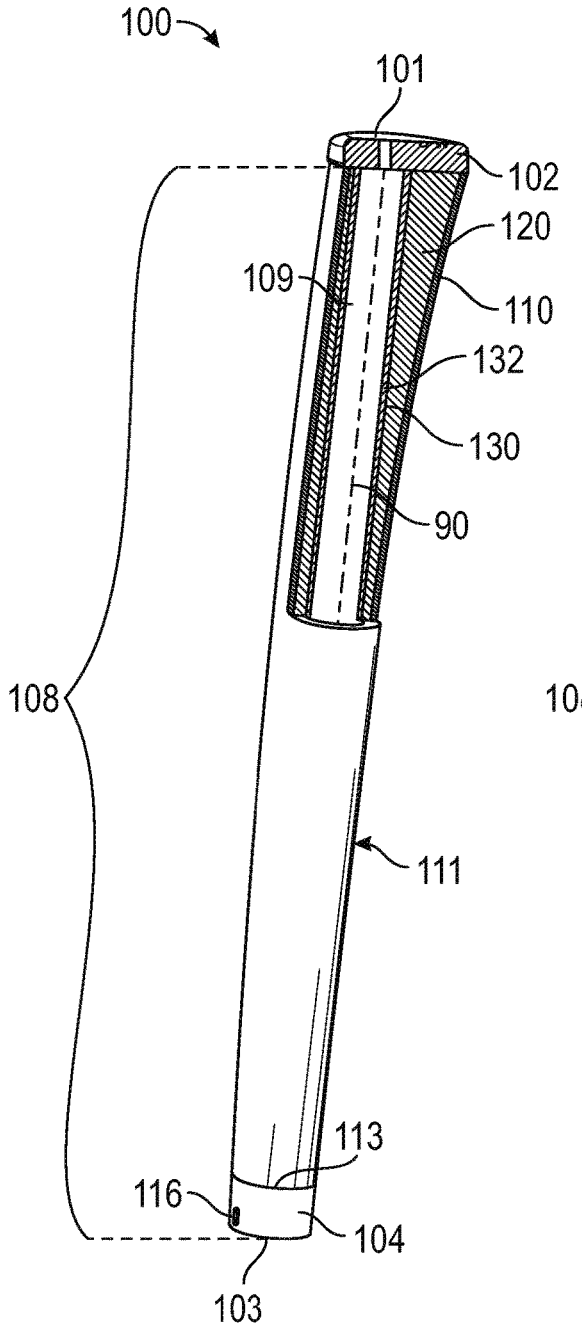
FIG. 3 is a perspective view of another embodiment of the grip of FIG. 1 with a portion of the grip cutaway.

FIG. 3 is a perspective view of another embodiment of the grip 100 of FIG. 1 with a portion of the grip 100 cutaway. Referring to FIG. 3, the body 108 may also include a core tube 132 inward from the foam layer 120. The composite shell 110 and the foam layer 120 may surround the core tube 132. The core tube 132 may adjoin the foam layer 120. The core tube 132 may be integral to the foam layer 120. The core tube 132 and the foam layer 120 may be bonded or otherwise joined together. The core tube 132 may form an inner sleeve of the grip 100 for the shaft 50 and may be formed to include the shaft cavity 109. In some embodiments, the core tube 132 and the composite shell 110 may be in contact adjacent to the open end 103. The cap 102, the core tube 132, and the composite shell 110 may enclose a volume that is filled by the foam layer 120. The core tube 132 may include a right circular cylinder shape.

The core tube 132 may include one or more layers of elastomeric materials, such as rubber, polyurethane, or thermoplastic elastomer. In some embodiments, the core tube 132 can include shock absorbing properties.

The core tube 132 and the cap 102 may be integral, such as bonded together, glued together, or molded as a unitary piece.

Figure 4:
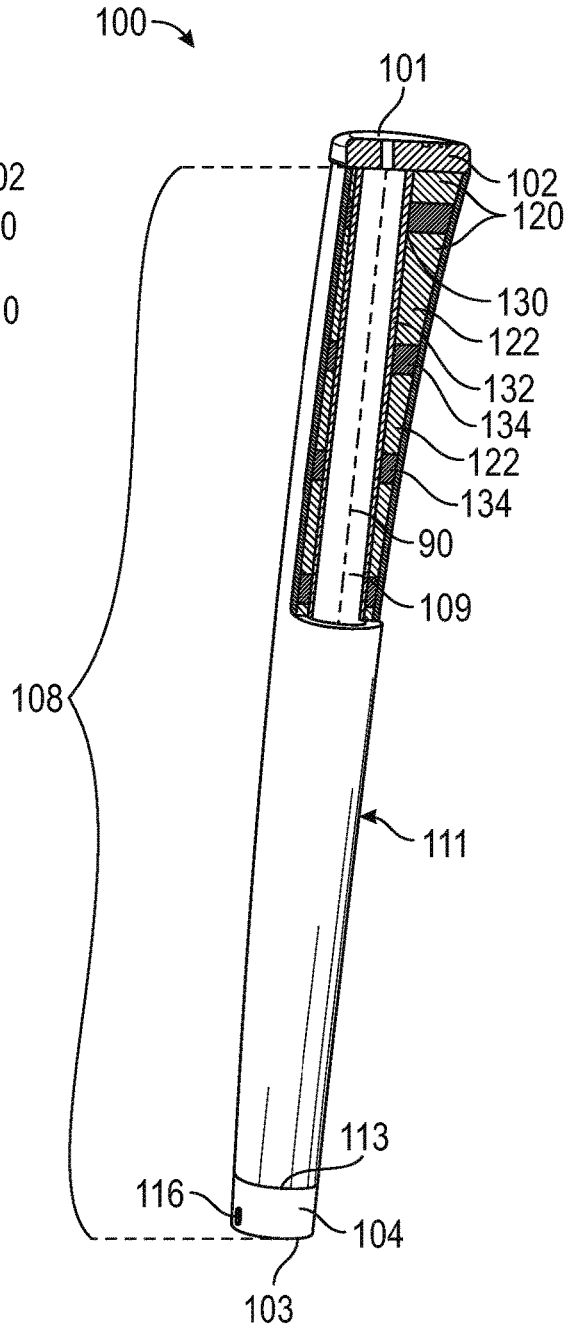
FIG. 4 is a perspective view of a further embodiment of the grip of FIG. 1 with a portion of the grip cutaway.

The composite shell 110 includes a composite shell end 113 which may not extend completely to the open end 103. The core tube 132 may extend to the composite shell end 113 and may extend beyond the composite shell end 113 to form a tip 104 that includes the open end 103 as illustrated in FIGS. 3 and 4. The tip 104 may be formed of an elastomeric material.

FIG. 4 is a perspective view of a further embodiment of the grip 100 of FIG. 1 with a portion of the grip 100 cutaway. Referring to FIG. 4, the body 108 may also include core protrusions 134. The core protrusions 134 may extend from the core tube 132 to the composite shell 110 through the foam layer 120. The core protrusions 134 may be interspersed throughout the foam layer 120.

The core protrusions 134 may be full or partial ribs extending around the circumference of the core tube 132, along the axis of the core tube 132 and along the shaft cavity axis 90, or may spiral about the core tube 132. The core protrusions 134 that are full ribs may subdivide the volume enclosed by the cap 102, the core tube 132 and the composite shell 110, and may subdivide the foam layer 120 into foam layer sections 122. The core protrusions 134 may also be spokes, such as partial ribs that extend partially around the circumference of the core tube 132 or tubes that extend outward from the core tube 132 to the composite shell 110.

Figure 5:
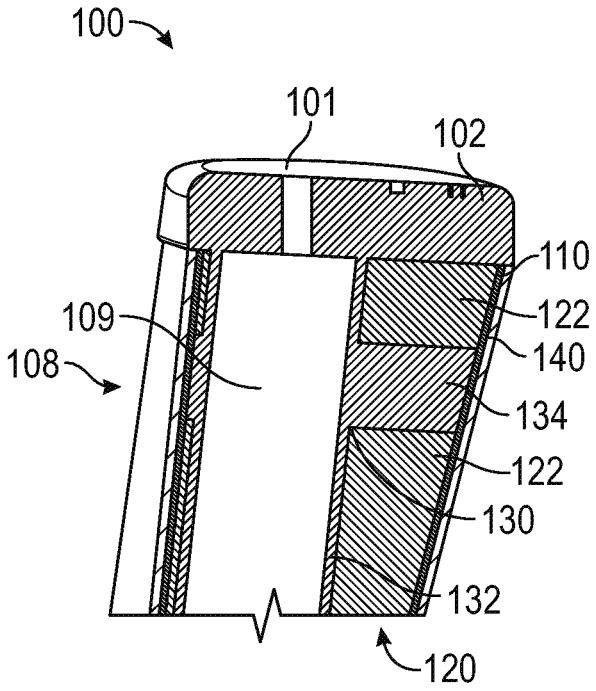
FIG. 5 is a cross-section of a portion of an embodiment of the grip of FIG. 1.

The core protrusions 134 and the core tube 132 are integral and may be joined or molded as a unitary piece as shown in FIG. 5. The core protrusions 134 may be formed of the same or similar materials as the core tube 132. The core protrusions 134 may include elastomeric materials, such as rubber, polyurethane, or thermoplastic elastomer, and can include shock absorbing properties.

FIG. 5 is a cross-section of a portion of an embodiment of the grip 100 of FIG. 1. The grip 100 may also include a surface coating 140 on the outer surface 111 of the composite shell 110. The surface coating 140 may improve the durability or the gripping properties of the grip 100. These properties include inter alia, an increased coefficient of friction at the outer surface 111, increased surface tack, and increased surface hardness. The surface coating 140 may include, inter alia, polyurethane coatings and rubber based coatings.

Figure 6:
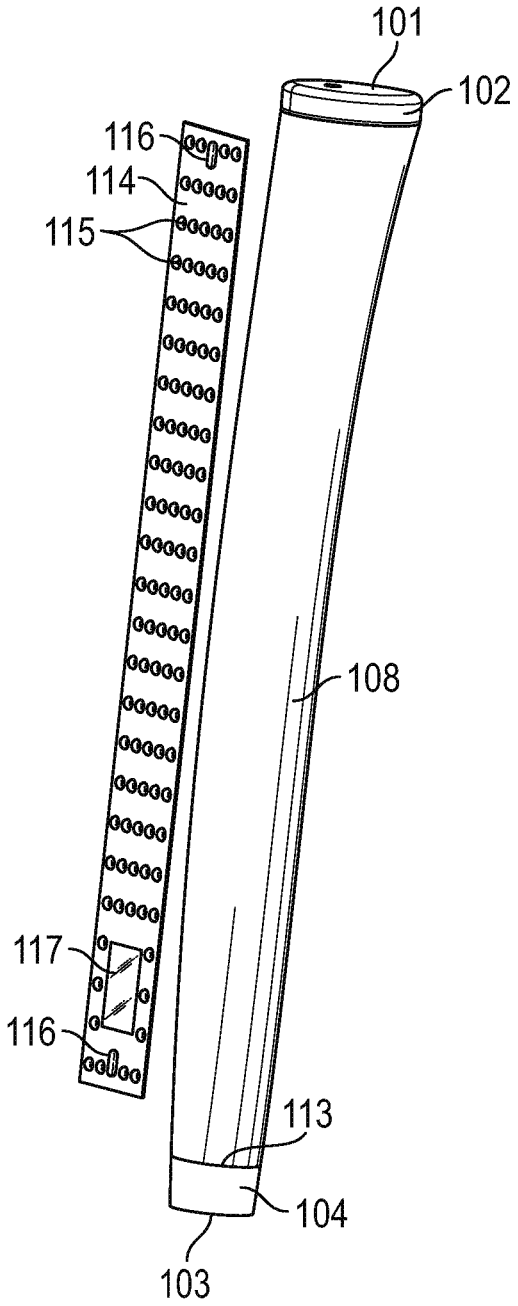
FIG. 6 is a perspective view of the grip of FIG. 1 illustrating an texture layer adjacent to the grip.

FIG. 6 is a perspective view of the grip of FIG. 1 illustrating a texture layer 114 adjacent to the grip 100. The texture layer 114 may be an overlay or an inlay. The texture layer 114 may be located within the composite material, inward of the composite material or outward from the composite material. During the manufacturing process, the texture layer 114 may be located between layers, such as sheets, of the reinforcement material prior to adding the binding matrix, located under the layers prior to adding the binding matrix, or may be located on the composite material after adding the binding matrix. The texture layer 114 may include tactile features 115, alignment features 116, and graphic features 117. The tactile features 115 may be protrusions, depressions, or a combination thereof. The alignment features 116 may also be protrusions, depressions or graphic in nature, and may be located adjacent the closed end 101 or the open end 103. Graphic features 117 may be, inter alia, images, logos, symbols, or a combination thereof.

Figure 7:
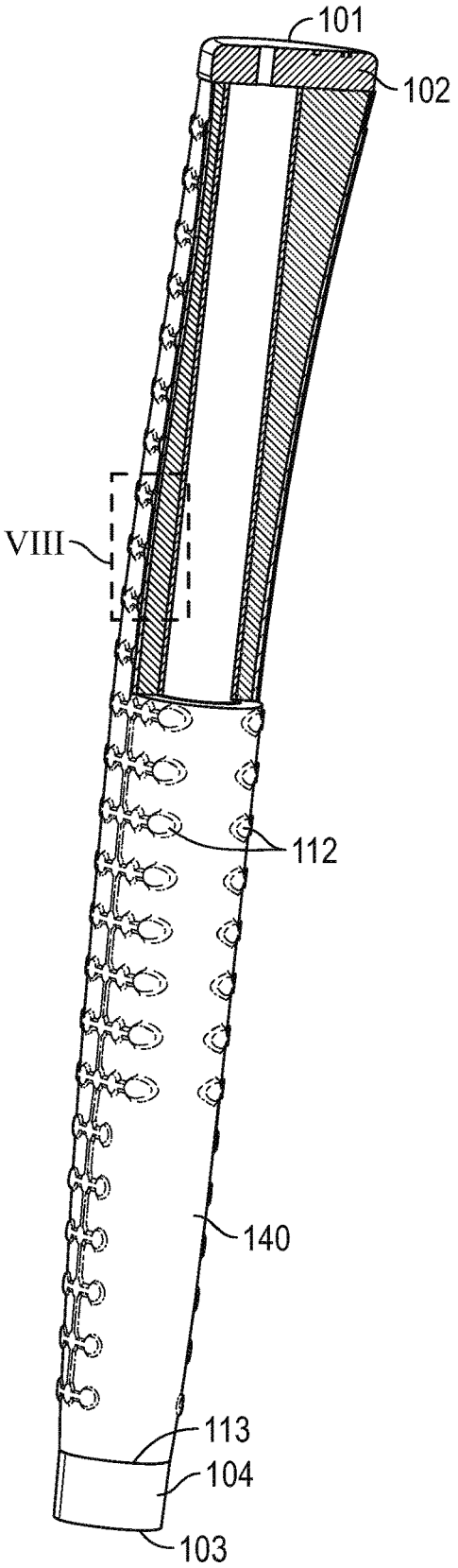
FIG. 7 is a perspective view of another embodiment of the grip of FIG. 1 with a portion of the grip cutaway.
Figure 8:
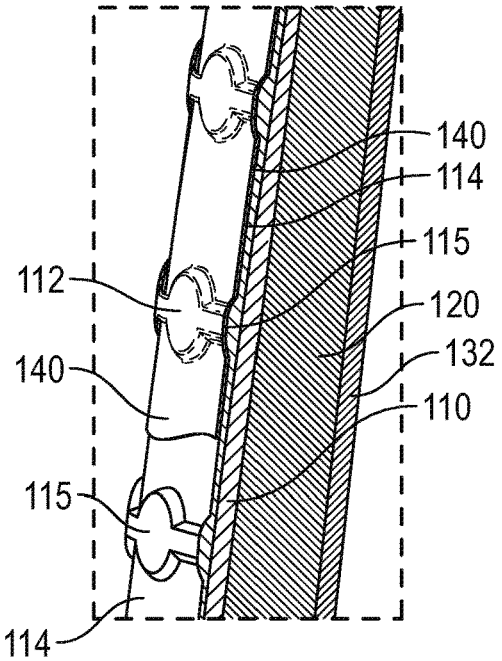
FIG. 8 is a detailed view of the portion of FIG. 7 enclosed by rectangle VIII in FIG. 7.

FIG. 7 is a perspective view of another embodiment of the grip of FIG. 1 with a portion of the grip cutaway. FIG. 8 is a detailed view of the portion of FIG. 7 enclosed by rectangle VIII in FIG. 7. A portion of the surface coating 140 in FIG. 8 is cutaway and not shown for illustrative purposes. In the embodiment illustrated in FIGS. 7 and 8, the texture layer 114 is located outward of the composite shell and may be a decal that is adhered to the outside of the composite shell 110. The texture layer 114 may be a continuous strip of material as illustrated, may be multiple strips of material that include tactile features 115, or may be individual tactile features 115.

In the embodiment illustrated, the surface coating 140 is located outward of the texture layer 114, with the texture layer 114 located between the composite shell 110 and the surface coating 140. In other embodiments, the texture layer 114 may be decals that are applied after the surface coating 140. The tactile features 115 may form some or all of the surface texture 112 of the grip 100.

The grip 100 as described herein may have a high modulus hybrid construction. The composite shell 110 may have a seamless construction and may not deflect inward when gripped, which can allow a golfer to grasp the grip comfortably and precisely no matter the gripping method the golfer uses. The composite shell 110 may also improve the durability of the grip 100.

The layered construction of the embodiments of the grip 100 described herein may allow for the fine tuning of the weight of the grip 100, such as by adjusting the thickness of each layer and by the foam density. The layered construction also allows for the fine tuning of the amount of vibration that reaches the golfer's hand. Dampening some of the vibration may filter the noise and allow proper vibrational feedback to reach the golfer's hand. This feedback may help the golfer feel how hard the ball was struck and where on the clubface the ball was struck, which may provide the golfer valuable information about the golfer's putting stroke.

The vibrational dampening and transference of vibration from the shaft 50 to the composite shell 110 may be tuned by, inter alia, the thickness of the core tube 132 and the amount of contact that the composite shell 110 has with the core tube 132, the core protrusions 134, and with the cap 102. While the core protrusions 134 may have some dampening properties, those properties may be less than the dampening properties of the foam layer 120. Thus, the amount vibrational transference to the composite shell 110 may be controlled by the pattern, shapes, and thicknesses of the core protrusions 134 and the contact area the core protrusions 134, the core tube 132, and the cap 102 each have with the composite shell 110.

The above description of the disclosed embodiments is provided to enable any person skilled in the art to make or use the invention. The described embodiments are not limited to use in conjunction with a particular type of golf club. Hence, although the present disclosure, for convenience of explanation, depicts and describes particular embodiments of the grip for a putter, it will be appreciated that the grip in accordance with this disclosure can be used with various other types of golf clubs, and can be used with other types of implements. Various modifications to these embodiments will be readily apparent to those skilled in the art, and the generic principles described herein can be applied to other embodiments without departing from the spirit or scope of the invention. Thus, any explanation in connection with one embodiment applies to similar features of other embodiments, and elements of multiple embodiments can be combined to form other embodiments. It is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art.

What is claimed is:

1. A golf grip for a golf club comprising:
- a closed end;
- an open end;
- a composite shell including a laminate composite fiber material forming a continuous surface from the open end to the closed end;
- a foam layer inward of the composite shell;
- a shaft cavity inward of the composite shell and the foam layer extending from the open end toward the closed end;
- a core tube inward of the foam layer, the core tube forming the shaft cavity; wherein the core tube includes a cap integral to the core tube, the cap forming the closed end, and wherein the core tube extends beyond the composite shell at the open end.

2. The golf grip of claim 1, further comprising core protrusions extending from the core tube to the composite shell through the foam layer.

3. The golf grip of claim 2, wherein the core protrusions include a rib that subdivides the foam layer into foam layer sections.

4. The golf grip of claim 1, a texture layer adjoining the outer surface of the composite shell, the texture layer including tactile features that form surface texture on the grip.

5. The golf grip of claim 4, further comprising a surface coating located outward of the texture layer and the composite shell, wherein the texture layer is located between the composite shell and the surface coating.

6. A golf grip for a golf club comprising:
- a body forming a shaft cavity for receiving a shaft of the golf club, the body having
- a closed end,
- an open end,
- a composite shell including a laminate composite fiber material forming a continuous surface from the open end to the closed end, and
- a foam layer inward of, adjoining, and integral to the composite shell; and
- a cap integral to the body at the closed end of the body, where the shaft cavity extends from the open end to the cap;
- a core tube inward of, adjoining, and integral to the foam layer;
- core protrusions extending from the core tube to the composite shell through the foam layer.

7. The golf grip of claim 6, wherein the core protrusions include a rib that subdivides the foam layer into foam layer sections.

8. The golf grip of claim 6, wherein the core tube includes an elastomeric material.

9. The golf grip of claim 6, wherein the foam layer includes closed cell polyurethane foam.

10. The golf grip of claim 9, further comprising a surface coating located at an outer surface of the composite shell.

11. A golf grip for a golf club comprising:
- a core tube forming a shaft cavity;
- a composite shell surrounding the core tube, the composite shell including a laminate fiber composite material, wherein the composite shell forms a hard outer shell having a continuous surface from a first end to a second end, the first end of the composite shell contacting the core tube adjacent an open end of the grip;
- a cap adjoining the core tube and the second end of the composite shell to form a closed end of the grip opposite the open end; and
- a foam layer filling a volume enclosed by the cap, the composite shell, and the core tube, where the composite shell, the foam layer, the core tube, and the cap are integral.

12. The golf grip of claim 11, further comprising core protrusions extending from the core tube to the composite shell through the foam layer.

13. The golf grip of claim 12, wherein the core protrusions include a rib that subdivides the volume between the cap, the composite shell, and the core tube, and wherein the foam layer is subdivided into foam layer sections.

14. The golf grip of claim 12, wherein the foam layer includes closed cell polyurethane foam, and the core tube and the core protrusions include an elastomeric material.

15. The golf grip of claim 11, wherein the core tube extends beyond the composite shell at the open end forming a tip of elastomeric material.

16. The golf grip of claim 11, further comprising a texture layer that forms tactile features on the grip.

* * * * *